US005193741A

United States Patent [19]

Magruder

[11] Patent Number: 5,193,741

[45] Date of Patent: Mar. 16, 1993

[54] UNISTRUCTURALLY FORMED MERCHANDISE DISPLAY CONTAINER AND COIN BOX

[76] Inventor: Mark Magruder, 1544 Becker Rd., Green Lane, Pa. 18054

[21] Appl. No.: 844,235

[22] Filed: Mar. 2, 1992

[51] Int. Cl.[5] ..... B65D 5/22

[52] U.S. Cl. ..... 229/8.5; 206/83; 206/84; 229/120.09; 229/120.18

[58] Field of Search ..... 229/8.5, 164, 120.09, 229/120.13, 120.18, 120.21, 120.38, 904.1; 206/83, 84, 44 R, 45.19; 232/1 D, 4 R

[56] References Cited

U.S. PATENT DOCUMENTS

| | | | |
|---|---|---|---|
| 706,231 | 8/1902 | Goldman . | |
| 837,442 | 12/1906 | Whitehead | 232/1 D |
| 1,179,720 | 4/1916 | Hart, Jr. | 229/8.5 |
| 1,628,208 | 10/1925 | White . | |
| 1,779,182 | 2/1929 | McEwen . | |
| 1,813,256 | 7/1931 | Radkus | 229/904.1 |
| 2,020,276 | 12/1934 | Fleischer | 229/8.5 |
| 2,054,291 | 10/1935 | Lambert | 229/8.5 |
| 2,259,245 | 10/1941 | Davis | 229/8.5 |
| 2,305,087 | 12/1942 | Keller | 229/904.1 |
| 2,326,683 | 8/1943 | Ross | 232/4 R |
| 2,409,047 | 10/1946 | Klein | 229/8.5 |
| 2,950,945 | 8/1960 | Holm | 312/118 |
| 4,671,455 | 6/1987 | Stockman | 232/1 D |
| 4,895,259 | 1/1990 | Paley | 229/164 |

FOREIGN PATENT DOCUMENTS

| | | | |
|---|---|---|---|
| 291329 | 5/1928 | United Kingdom | 206/44 R |

*Primary Examiner*—Gary E. Elkins
*Attorney, Agent, or Firm*—Eric A. LaMorte

[57] ABSTRACT

The present invention is a honor based merchandise display or similar container that includes a merchandise display compartment and coin box compartment unistructurally formed from a folded blank of paper based material. Access to the contents of the coin box compartment is deterred by the use of a non-reversible locking tie, the presence of dividers within the display compartment and the orientation of the folds in the blank used to construct the coin box compartment.

19 Claims, 6 Drawing Sheets

UNISTRUCTURALLY FORMED MERCHANDISE DISPLAY CONTAINER AND COIN BOX

BACKGROUND OF THE INVENTION

1. Field of the Invention

The present invention relates to open honor based merchandise display boxes that include a coin compartment, so that money can be donated when an article of merchandise is removed from the display box by a consumer, and more particularly to such merchandise containers wherein a merchandise compartment and coin compartment are unistructurally constructed from a single shaped blank of paper based material, folded in such a manner so as to deter the theft of monies from the coin compartment.

2. Prior Art Description

Merchandise has been sold to consumers, based on an honor system, probably since the creation of coined money. The honor system sale of merchandise includes the open display of the merchandise to the public so that a consumer may take of the merchandise as desired. Located either near, or on, the merchandise display is a coin box and a suggested price. The consumer is then trusted to deposit the proper amount of money into the coin box, corresponding to the suggested value of the merchandise that has been removed from the display. Such honor based merchandise displays are commonly called donation boxes or honor boxes, since there is no mechanism that prevents a consumer from removing merchandise from the display without paying.

Honor based merchandise displays are usually placed in public or semi-public areas, so as to maximize the number of potential consumers for the goods on display. However, often the location of the honor based merchandise display is unsupervised, leaving the merchandise display vulnerable to theft. There are three types of theft that commonly occur to honor based merchandise displays. The first is the most common and includes a person taking a displayed article of merchandise and failing to pay. This type of theft is commonplace and is considered part of the cost of doing business with honor based merchandise displays. The second type of theft is less common, but more costly to the owner of the honor based merchandise display, and includes the theft of money from the coin compartment of the display. As has been described, the honor based merchandise displays include coin box compartments. As merchandise is sold to honest consumers, the coin box fills with money creating a tempting target for theft. However, although the honor based merchandise displays are unsupervised, they are located in public or semipublic areas. As such, a thief who steals money from an honor based merchandise display usually does so in a rapid fashion, while no other people are around. This usually results in the merchandise display being destroyed or otherwise severely damaged as the thief rapidly attempts to reach the money contained within the coin box.

The third type of theft that occurs to honor based merchandise displays is when the entire display is stolen. In such a scenario the owner of the merchandise display loses all the merchandise on display, all the money contained within the coin box and the value of the merchandise display itself.

Little can be done to eliminate the theft of merchandise, without payment, from an honor based merchandise display. To do so, a person would have to replace the honor based merchandise display with a dedicated vending machine, costing thousands of dollars. However, the theft of money from an honor based merchandise display can be economically deterred by decreasing the accessibility of the coin box, thereby increasing the time involved in removing money from the display and increasing the likelihood a thief would detected during the theft. Additionally, the loss incurred when a merchandise display is severely damaged, or stolen in its entirety, can be reduced by producing merchandise displays that are very inexpensive. As such, the merchandise displays can be readily replaced with little financial loss to the owner of the displays.

In an attempt to deter theft, and promote long life in the honor based merchandise displays, some prior art displays were constructed of metal. Such prior art merchandise displays are exemplified in U.S. Pat. Nos.: 1,628,208 to White and 1,779,182 to McEwen. In both references the display itself is constructed from sheet metal and the coin boxes are separately formed units positioned within the sheet metal displays. The sheet metal manufacture of these displays made the merchandise displays very difficult to assemble and very expensive to manufacture, replace or repair.

Prior art honor based merchandise displays that were made inexpensively are exemplified by U.S. Pat. No.: 4,671,455 to Stockman. The Stockman patent shows a display formed from folded paperboard, however the display and the coin box are formed as separate units, and the coin box is given little protection by the paperboard display. The separate formation of the merchandise display and the coin box requires the creation of a separate manufacturing tool and a separate assembling procedure for both the merchandise display and the coin box, increasing the cost of the overall display. Additionally, by providing a separate coin box within the merchandise display, a thief now has a nice container to carry away the money that has been stolen, thus decreasing the time and difficulty required in stealing the money from the merchandise display. To exemplify the difficulty of manufacturing and assembling paperboard coin boxes, refer to U.S. Pat. Nos. 2,020,276 to Fleischer and 2,409,047 to Klein. As can be seen from these cash box references, the separate construction of a coin box will create complicated tooling and assembly procedures that will be reflected in the cost of coin boxes.

Prior art references that make it difficult to remove money from an honor based merchandise display are exemplified in U.S. Pat. Nos.: 2,054,291 to Lambert and 2,950,945 to Holm. In the Lambert patent a separately formed coin chamber is positioned under the merchandise so that the merchandise in the display must be removed before the coins could be accessed. However the Lambert patent presents little deterrence to a thief when the merchandise is low or empty and the coin chamber is full. The Holm patent shows a separate locked coin chamber, however the production of such a coin chamber would add significantly to the cost and difficulty in manufacturing the merchandise display.

In view of the disadvantages present in the prior art, it is a primary objective of the present invention to set forth an honor based merchandise display having both a merchandise compartment and a coin box compartment unistructurally formed from a paper material such as pasteboard, cardboard, or other paperboard, thereby creating a low cost merchandise display that is easy to manufacture and assemble and deters theft by limiting unauthorized access to monies contained within the coin box.

SUMMARY OF THE INVENTION

The present invention is a honor based merchandise display box or similar container that includes a merchandise display compartment and a coin box compartment formed by folding a single shaped blank of pasteboard, cardboard or other paper board material. The coin box compartment is entirely enclosed except for the presence of a coin slot, formed through one wall of the coin box compartment, that allows money to be inserted into the coin box compartment. Money contained within the coin box compartment is accessed by unfolding the section of the blank forming the coin box compartment. To prevent the unauthorized removal of money from the coin box compartment, a non-reversible locking tie is placed through a plurality of apertures formed within adjacent walls of both the display compartment and the coin box compartment. The presence of the locking tie prevents the coin box container from being unfolded without first destructively removing the locking tie or damaging the coin box compartment. The unauthorized removal of money from the coin box compartment is further deterred by the manner in which coin box compartment is foldably constructed. To unfold the coin box compartment, in a non-destructive fashion, the coin box container must be unfolded in a direction toward the merchandise display compartment. When the merchandise display compartment is full with articles of merchandise, the articles of merchandise interfere with the unfolding of the coin box compartment, requiring the articles of merchandise to be removed from the area of the display compartment that adjoins the coin box compartment. Additionally, dividing members are positioned within the display compartment so as to divide the articles of merchandise into separate columns. The dividing members also prevent the unfolding of the coin box compartment, thereby requiring the dividing members be removed from the display compartment before the coin box compartment can be unfolded.

The elements of the present invention merchandise display, combine to create an inexpensive, easily manufactured and easily assembled display box that include a integrally formed coin box compartment that is difficult to access and therefore deters theft.

BRIEF DESCRIPTION OF THE DRAWINGS

The invention will be more fully understood by referring to the following detailed specification, the above specification and the claims set forth herein, when taken in connection with the drawings appended hereto, wherein:

DETAILED DESCRIPTION OF THE DRAWINGS

The present invention is a unistructurally formed container having an open compartment and a sealed compartment. As such, the present invention can be used in many applications where it is desired to actively secure some goods within one compartment of a container, limiting access to those goods by unauthorized personnel. However, the present invention is particularly advantageous in the construction of honor based merchandise displays. Consequently, the below described drawings are directed toward one exemplary embodiment of the present invention whereby the present invention is used to construct an honor based merchandise display.

Figure 1:
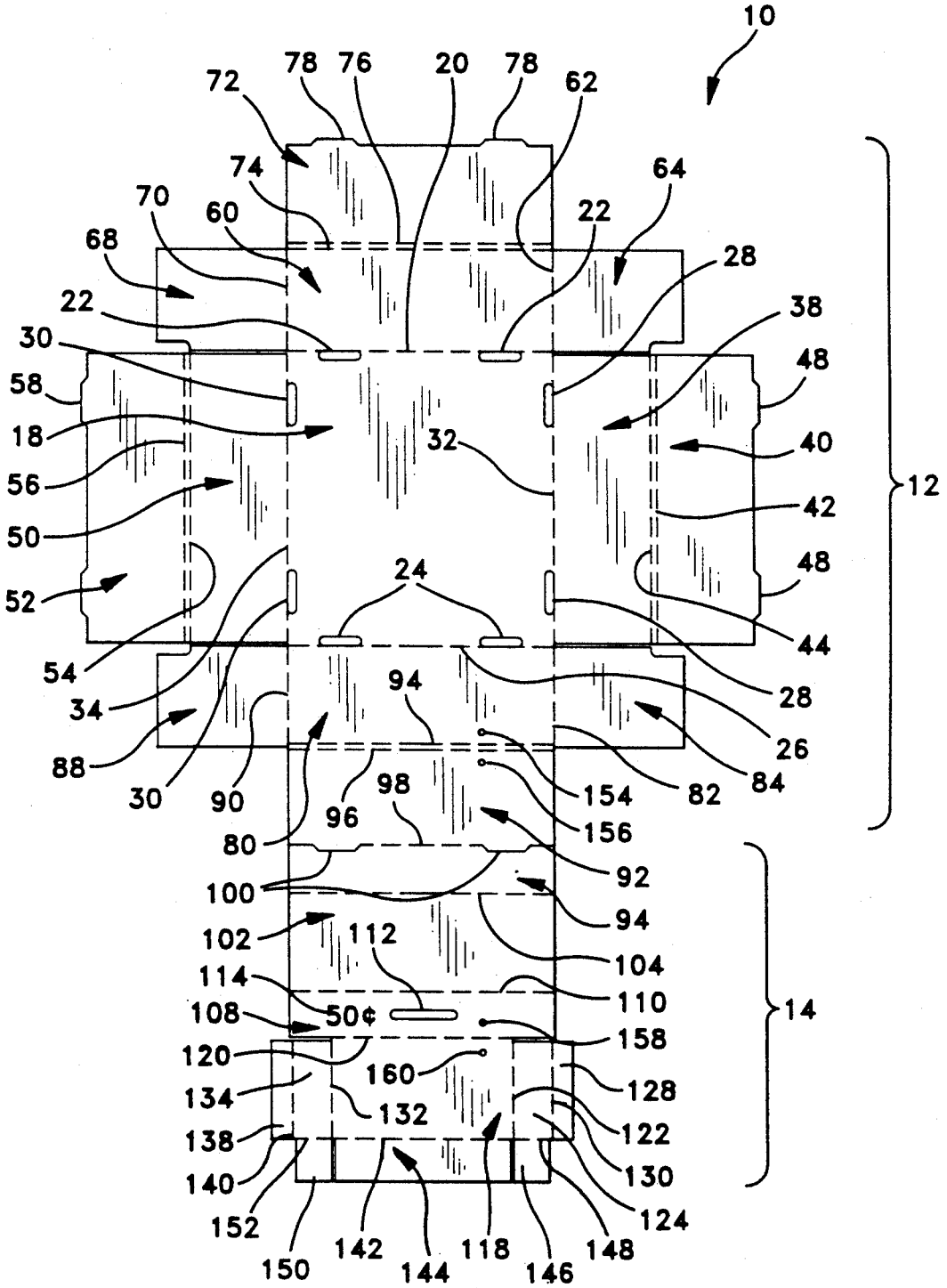
FIG. 1 is a top view of one preferred embodiment of the shaped blank of the present invention display box presented in an unfolded condition.

Referring to FIG. 1 an exemplary embodiment of the present invention merchandise display box 10 is shown. The present invention merchandise display box 10, like prior art honor based merchandise displays, includes a merchandise compartment and a coin box. The present invention forms the merchandise compartment and the coin box by folding a single unistructural sheet of material, thereby decreasing the cost and labor involved in manufacturing the present invention display box 10 and increasing the ease by which the display box 10 is assembled. The present invention display box 10 is formed from a single shaped blank of material that can be repeatedly folded and unfolded. Although the present invention can be formed of plastic with integral living hinges, the present invention is preferably constructed of a paper based material such as pasteboard, cardboard or corrugated paperboard.

As can be seen from FIG. 1, the present invention display box 10 is constructed by appropriately folding the plurality of formed flaps and panels into which the blank of paper based material was cut. As will be later explained, segments contained in the upper region 12, of the blank of paper material, will create merchandise compartment of the present invention and the segments in the lower region 14, of the blank of paper material, will create the coin box compartment of the present invention. Furthermore, many of the flaps and panels formed on the blank of the present invention are divided along folding lines. The folding lines mat be perforated or otherwise pre-stressed to promote ease of folding. Referring to the upper region 12 of the present invention display box 10, there is shown a centrally positioned box base 18. On the top edge 20 of the box base 18 are formed two elongated apertures 22. An opposing pair of aperture slots 24 are symmetrically formed at the bottom edge 26 of the box base 18. Similarly, symmetrically disposed pairs of aperture slots 28, 30 are formed through the box base 18 along its right edge 32 and left edge 34, respectively.

Extending from the right edge 32 of the box base 18 is a right outside wall panel 38. Depending from the outside wall panel 38, opposite the box base 18, is a right inside wall panel 40, formed to be substantially the same size as the right outside wall panel 38. The right outside wall panel 38 and the right inside wall panel 40 are separated by two folding lines 42, 44. The distance in between the first folding line 42 and the second folding line 44 is substantially equivalent to the thickness of paper based material from which the blank of the present invention display box 10 was cut. Extending from the right outside wall panel 40, opposite the first and second folding lines 42, 44, are two right locking tabs 48, each locking tab 48 corresponding in location to the elongated apertures 28 formed along the right edge 32 of the box base 18.

Extending from the left edge 34 of the box base 18 is a left outside wall panel 50. Depending from the left outside wall panel 50, opposite the box base 18, is a left inside wall panel 52, formed to be substantially the same size as the left outside wall panel 50. The left outside wall panel 50 and the left inside wall panel 52 are divided by a first and second folding line 54, 56, wherein the distance in between the first and second folding line 54, 56 is substantially equivalent to the thickness of the paper based material from which the blank of the present invention display box 10 is being cut. Extending from the left inside wall panel 52, opposite the first and second folding lines 54, 56, are two left locking tabs 58, each left locking tab 58 corresponding in location to the elongated apertures 30 formed along the left edge 32 of the box base 18.

Extending from the top edge 20 of the box base 18 is a top outside wall panel 60. Depending from the right edge 62 of the top outside wall panel 60 is a top right wall flap 64. Similarly, a top left wall flap 68 extends from the left edge 70 of the outside wall panel 70. Extending from the top outside wall panel 60, opposite the base box 18, is a top inside wall panel 72. The top outside wall panel 60 and the top inside wall panel 72 are substantially the same size and are divided by a first and second folding lines 74, 76. Two top locking tabs 78 extend from the top inside wall panel 72, opposite the first and second folding lines 74, 76. The top locking tabs 78 corresponding in location to the elongated apertures 22 formed along the top edge 20 of the box base 18.

Extending from the bottom edge 26 of the box base 18 is a bottom outside wall panel 80. Depending from the right edge 82 of the bottom outside wall panel 80 is a bottom right wall flap 84. In an opposed position, a bottom left wall flap 88 depends from the left edge 90 of the bottom outside wall panel 80. Extending from the bottom outside wall panel 80, opposite the box base 18 is a bottom outside wall panel 92. The bottom outside wall panel 80 and the bottom inside wall panel 92 are substantially the same size and are divided by two folding lines 94, 96.

Referring now to the lower region 14 of the present invention display box 10 it can be seen that a coin box back wall panel 94 extends from the bottom inside wall panel 92, opposite the bottom outside wall panel 80. The coin box back wall panel 94 and the bottom inside wall panel 92 are separated by folding line 98. However, the folding line 98 does not transgress the entire length between the bottom inside wall panel 92 and the coin box back wall panel 94. Two bottom locking tabs 100 extend from the bottom inside wall panel 92 and are not part of the coin box back wall panel 94. As such, the bottom locking tabs 100 remain in the plane of the bottom inside wall panel 92 when folded along folding line 98.

Extending from the coin box back wall panel 94, opposite the bottom inside wall panel 92, is a coin box top wall panel 102. The coin box top wall panel 102 and the coin box back wall panel 94 are separated along folding line 104. Extending from the coin box top wall panel 102, opposite the coin box back wall panel 94, is a coin box face panel 108. The coin box face panel 108 is separated from the coin box top wall panel 102 along folding line 110. As can be seen from FIG. 1, the coin box back wall 94, the coin box top wall panel 102 and the coin box face panel 108 have substantially the same width as the bottom inside wall panel 92.

Centrally positioned on the coin box face panel 108 is a coin slot 112. Also positioned on the coin box face panel 108 is an indicia 114, the position and significance of which will be later described. Extending from the coin box face panel 108, opposite the coin box top wall panel 102 is the coin box bottom panel 118. The coin box bottom panel 118 is divided from the coin box face panel 108 along folding line 120. Extending from the right edge 122 of the coin box bottom panel 118 is the coin box right wall panel 124. Extending from the coin box right wall panel 124 is a right support flap 28, separated from the coin box right wall panel 124 along folding line 130. Extending from the left edge 132 of the coin box bottom panel 118 is a coin box left wall panel 134. Depending from the coin box left wall panel 134, opposite the coin box bottom panel 118, is a left support flap 138. The left support flap 138 is joined to the left wall panel 134 along folding line 140.

Extending from the bottom edge 142 of the coin box bottom panel 118 is a coin box inner back wall panel 144. Similarly, a right inner back wall support flap 146 extends from the bottom edge 148 of the coin box right wall panel 124 and a left inner back wall support flap 150 extends from the bottom edge 152 of the coin box left wall panel 134.

Also shown in FIG. 1, are a plurality of lock apertures. A first lock aperture 154 is formed through the bottom outside wall panel 80 at a position adjacent to the first folding line 94. A second lock aperture 156 is positioned on the bottom inside wall panel 92, adjacent to the second folding line 96, so as to be the mirror image of the first lock aperture 154. A third lock aperture 158 is formed through the coin box face panel 108 at a position adjacent to folding line 120. A fourth lock aperture 160 is formed through the coin box bottom panel 118 on the opposite side of the folding line 120 so as to be a mirror image of the third lock aperture 158.

Figure 2:
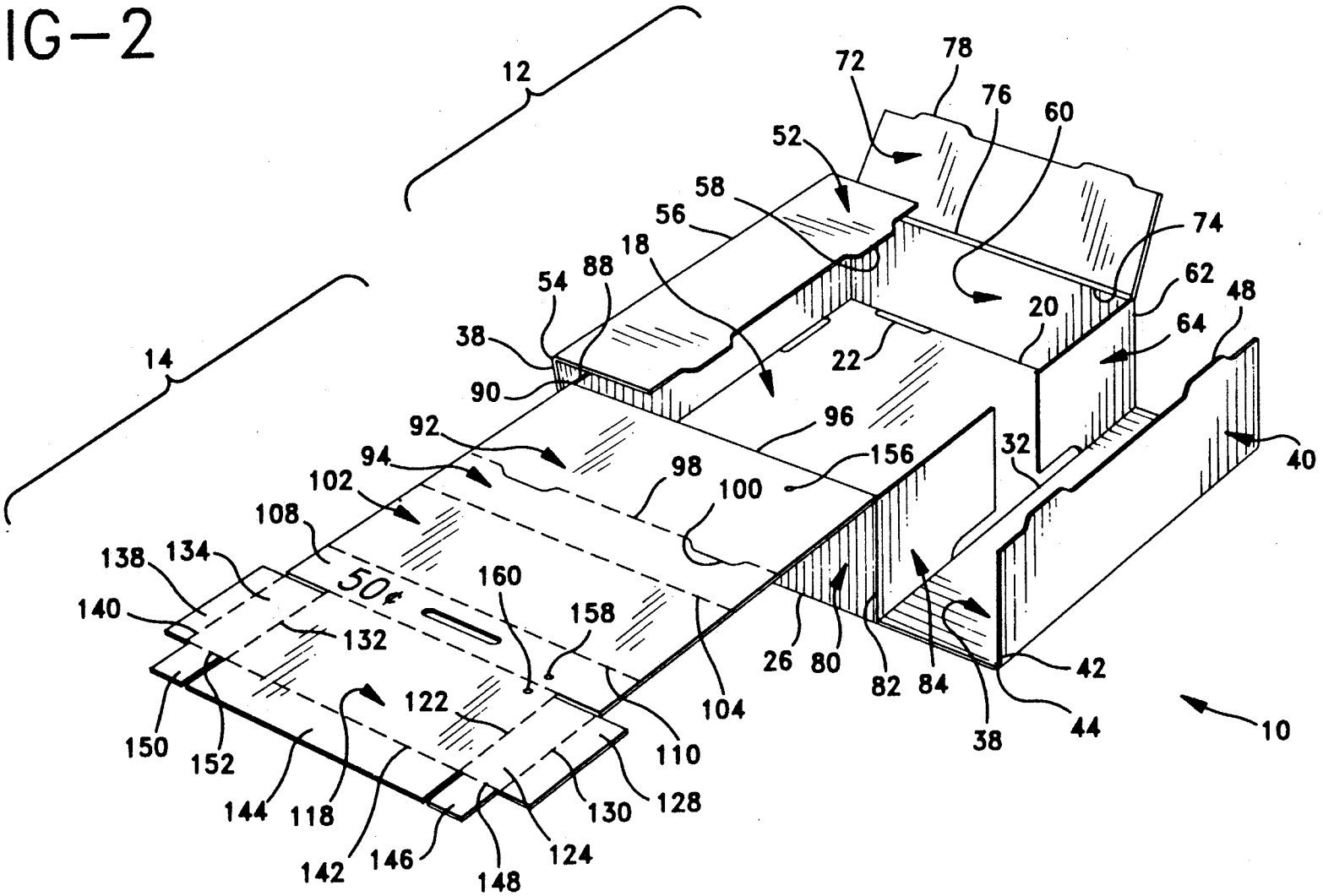
FIG. 2 is a perspective view of the preferred embodiment of the present invention display box having the merchandise display section shown in a partially assembled manner.

Referring now to FIG. 2 in conjunction with FIG. 1, the first steps of assembling the present invention display box 10 from the unistructural sheet of material shown in FIG. 1 can be described. In FIG. 2, the assembly of the merchandise compartment from the upper section 14 of the present invention display box 10 is begun by folding the top outside wall panel 60 to a plane perpendicular to the box base 18 along the top edge 20 of the box base 18. The top right wall flap 64 and the top left wall flap 68 are then folded along the right edge 62 and the left edge 70 of the top outside wall panel 60, respectively, to a position that is perpendicular to both the box base 18 and the top outside wall panel 60. Similarly, the bottom outside wall panel 80 is folded along the bottom edge 26 of the box base 18 into a plane that is perpendicular to the box base 18. The bottom right wall flap 84 and bottom left wall flap 88 are then folded along the right edge 82 and left edge 90 of the bottom outside wall panel 80, respectively, into a plane that is perpendicular to both the box base 18 and the bottom outside wall panel 80.

Figure 3:
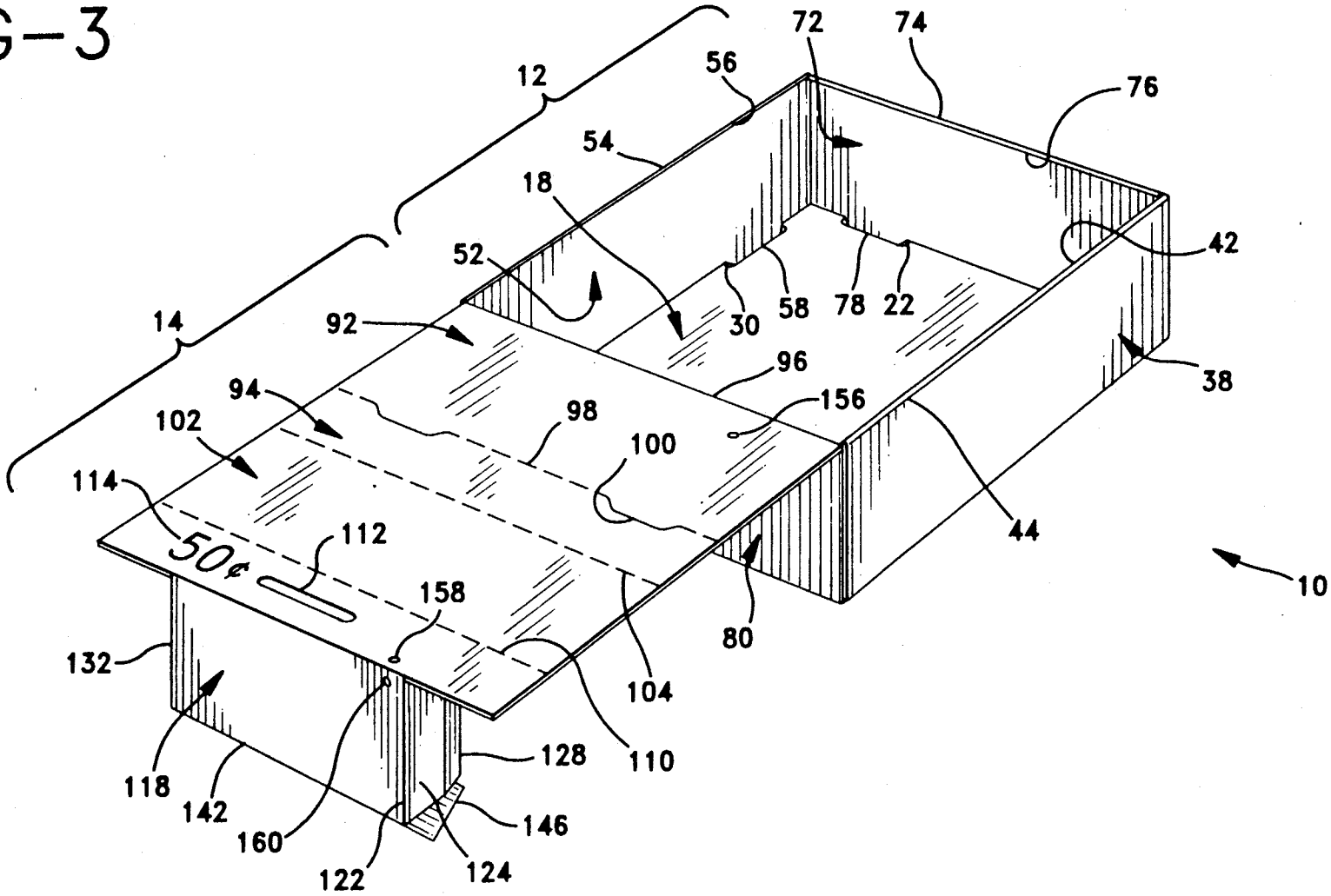
FIG. 3 is a perspective view of the preferred embodiment of the present invention display box having the merchandise display section fully assembled and the coin box section shown in a partially assembled manner.

With the side flaps of the top outside wall panel 60 and the bottom outside wall panel 80 in place, the right outside wall panel 38 is folded into a plane perpendicular to the box base 18 along the right edge 32 of the box base 18. Similarly, the left outside wall panel 38 is folded into a plane perpendicular to the box base 18 along the left edge 34 of the box base 18. Referring now to FIG. 3 in conjunction with FIGS. 1 and 2 it can be seen that the right inside wall panel 40 is folded over the right outside wall panel 38 by creating two perpendicular folds along the first folding line 42 and the second folding line 44. The right inside wall panel 40 folds over the top right wall flap 64 and the bottom right wall flap 84. The locking tabs 48 that extend from the right inside wall panel 40 pass into the elongated apertures 28 formed along the right edge of the box base 18. The top right wall flap 64 and the bottom right wall flap 84 thereby become enveloped in between the right inside wall panel 40 and the right outside wall panel 38. In a similar manner, the left inside wall panel 52 is folded over the top left wall flap 68 and the bottom left wall flap 88. The locking tabs 58, that extend from the left inside wall panel 52, pass into the elongated apertures 30 formed along the left edge 34 of the box base 18, thereby enveloping the top left wall flap 68 and the bottom left wall flap 88. The folds created along the first folding line 54 and second folding line 56 create the space needed in between the left inside wall panel 52 and the left outside wall panel 50 to accommodate the width of the left top wall flap 68 and the left bottom wall flap 88.

The top inside wall panel 72 is folded inwardly over the top outside wall panel 60. The top outside wall panel 60 fits in between the right inside wall panel 40 and the left inside wall panel 52. The lock tabs 78 extending from the top outside wall panel 60 pass into the elongated slots 22 formed along the top edge 20 of the box base 18.

With the top inside wall panel 72, the right inside wall panel 40 and the left inside wall panel 52 folded over and locked into their respective elongated slots, it can be seen that the upper region 12 of the present invention display box 10 now forms the shape of a box with an open top. The bottom wall of the formed box has the lower region 14 depending from it, which will be folded into a coin box compartment. Referring in unison to FIGS. 1-3 it can be seen that the coin box bottom panel 118 is folded along folding line 120 into a plane that is perpendicular to the coin box face panel 108. The coin box right wall panel 124 and left wall panel 134 are folding along the right edge 122 and the left edge 132, respectively, of the coin box bottom panel 118, creating the side walls of the coin box. The coin box inner wall back panel 144 is folded along folding line 142 into a plane perpendicular to the coin box bottom panel 118, thus assuming a position parallel to the coin box face panel 108 on the opposite side of the coin box bottom panel 118. With the coin box face panel 108, the coin box inner wall back panel 144, the coin box left wall panel 134 and the coin box right wall panel 148 folded to be perpendicular to the coin box bottom panel 118, it can be seen that a coin box with a bottom and four walls is created. The left inner wall support flap 150 and the right inner wall support 146 fold to the inside of the coin box left wall panel 134 and the coin box right wall panel 124, respectively, as the coin box inner wall back panel 144 is folded perpendicular to the coin box bottom panel 118.

Figure 4:
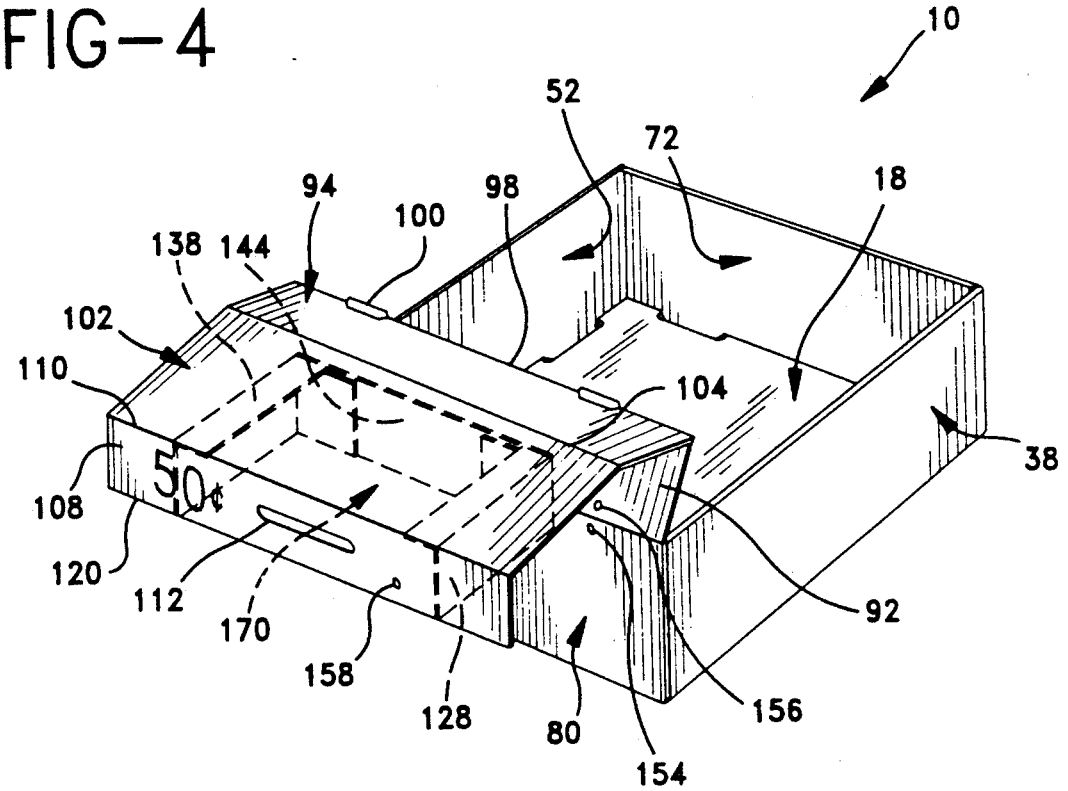
FIGS. 4 and 5 show perspective views of the preferred embodiment of the present invention display box showing the further assembly of the coin box section.
Figure 5:
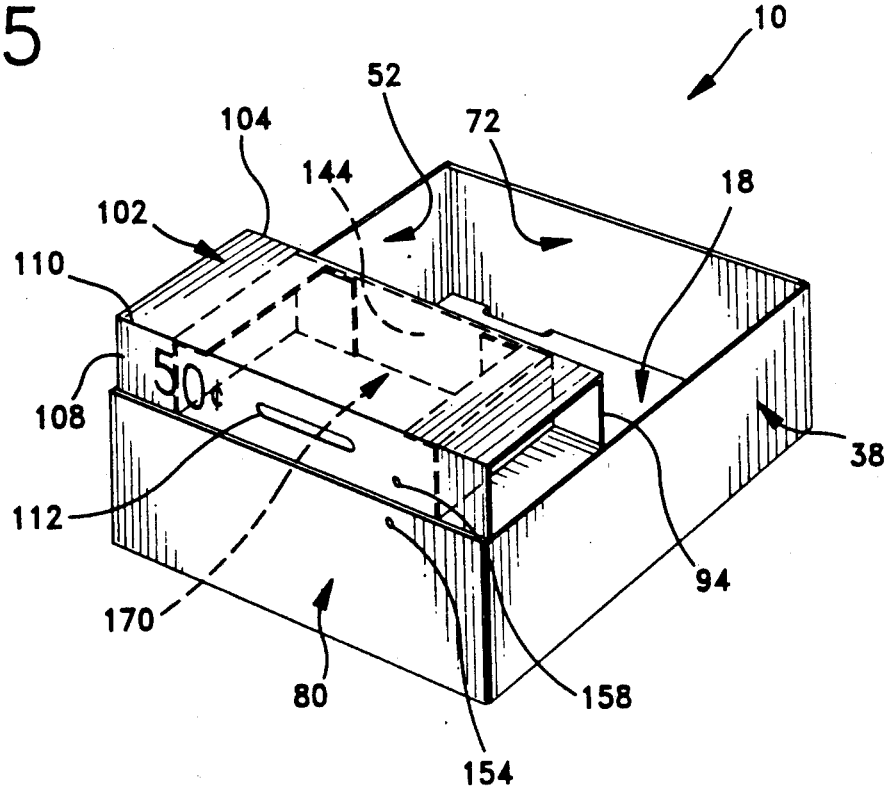

Referring to FIGS. 4 and 5 in conjunction with the previously described figures, the coin box face panel 108 is folded along folding line 120 into a plane substantially perpendicular to the coin box top wall panel 102. As the coin box face panel 108 is folded along line 120, the left support flap 138 and the right support flap 128 abut against the coin box top wall panel 102. The coin box top wall panel 102 also abuts against the top of the coin box inner back wall panel 144, creating an enclosed compartment in between the coin box top wall panel 102, the coin box bottom panel 118 and the four depending walls. The enclosed compartment formed is the coin box 170 and the hollow within the coin box 170 is only accessed through the coin slot 112 formed within the coin box face panel 108.

The coin box top wall panel 102 is folded along fold line 104 into a plane that is perpendicular to the coin box back wall panel 94. As the coin box top wall panel 102 is folded perpendicular to the coin box back wall panel 94, the coin box back wall panel 94 abuts against the coin box inner back wall panel 102. The abutment of the coin box back wall panel 94 against the coin box inner back ball panel 102 prevents the coin box inner back wall panel 102 from unfolding and preserves the integrity of the coin box 170.

The coin box back wall panel 94 is folded along folding line 98 into a plane perpendicular to the bottom inside wall panel 92. As such, the bottom inside wall panel 92 abuts against the coin box bottom panel 118, further preventing the unfolding of the coin box 170. The folding of the coin box back wall panel 94 into a plane perpendicular to the bottom inside wall panel 92 also allows the locking tabs 100 to leave from the plane of the coin box back wall panel 94 and extend above the bottom inside wall panel 92.

Figure 6:
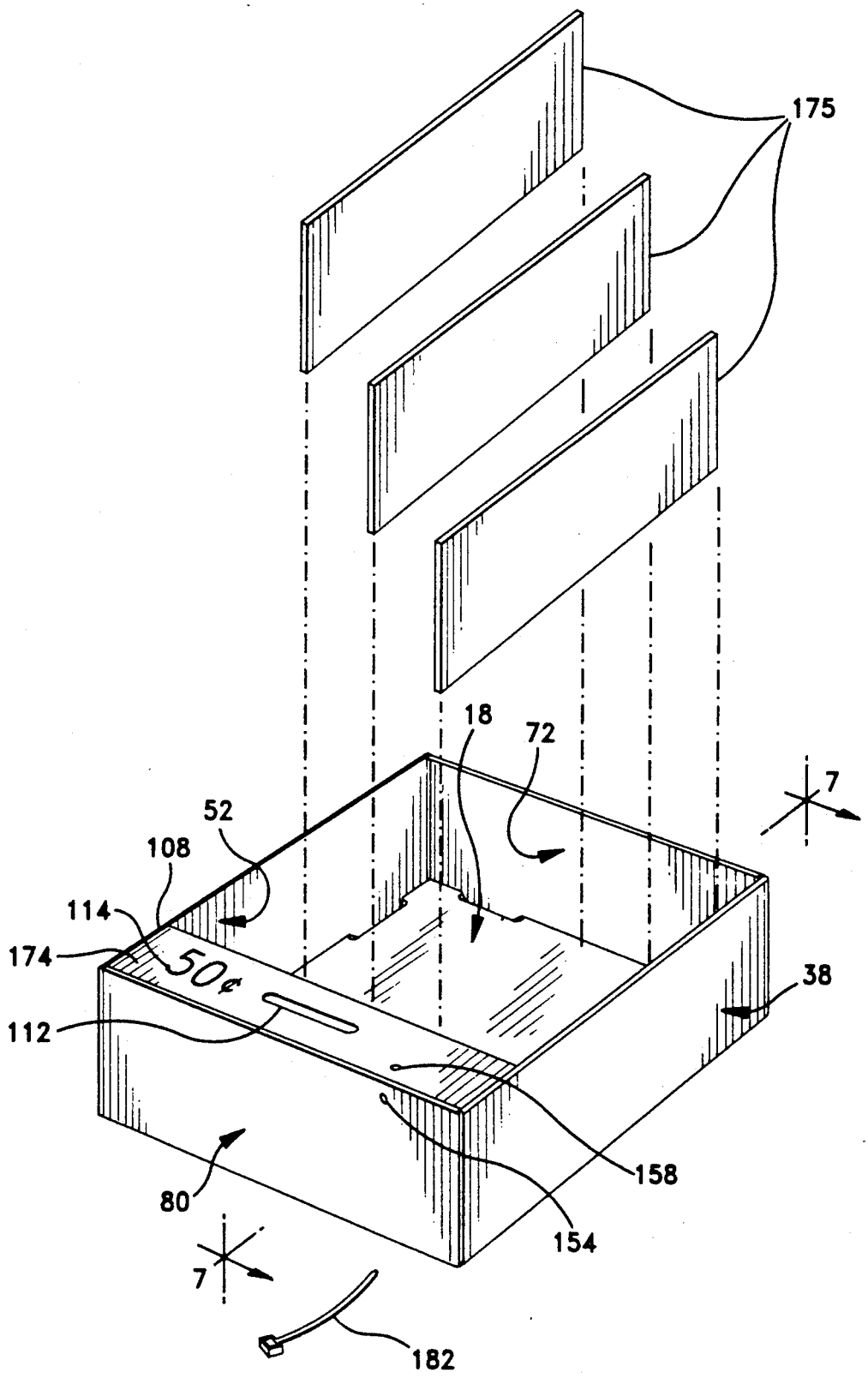
FIG. 6 shows an exploded perspective view of the preferred embodiment of the present invention fully assembled.

Referring to FIG. 6 in conjunction with FIGS. 1-5 it can be seen that the bottom inside wall panel 92 and the coin box 170 positioned above the bottom inside wall panel 92, are folded into the larger box by creating a fold along folding line 98. The bottom outside wall panel 92 is folded over the bottom inside wall panel 80 until the locking tabs 100 enter the elongated slots 24 formed along the bottom edge 26 of the box base 18. As the bottom outside wall panel 92 folds over the bottom inside wall panel 80, the first lock aperture 154 formed through the bottom outside wall panel 92 aligns with the second lock aperture 156 formed through the bottom inside wall panel 80.

In FIG. 6, the present invention display box 10 is shown in a fully assembled orientation. As can be seen, the coin box face panel 108 faces forward in the assembled display box 10 and the display box 10 is now composed of two separate sections. An open merchandise display section 172 and a closed coin box assembly 174 positioned at one end of the merchandise display. The coin box assembly 174 was created by the folding of the lower section 14 of the paper based blank and is now positioned within the larger display box created by folding the upper section 12 of the blank. Optionally positioned within the merchandise display section 172 are a plurality of compartment dividers 175. The compartment dividers 175 traverse the merchandise display section 172 in between the top inside wall panel 72 and the coin box top panel 102. The compartment dividers 175 divide the merchandise display section 172 into a plurality of columns so that various articles of manufacture can be separately displayed within separate columns. The compartment dividers 175 abut against both the top inside wall panel 72 and the coin box top panel 102. As such, the compartment dividers 175 prevent the unfolding of the coin box assembly until the compartment dividers 175 are removed from the merchandise display section 172. If the space in between the compartment dividers 175 were full with articles of merchandise, it should be recognized that the articles of manufacture would also have to be removed from abutment with the coin box top panel 102 in order for the coin box top panel 102 to be unfolded and the coin box 170 accessed.

Figure 7:
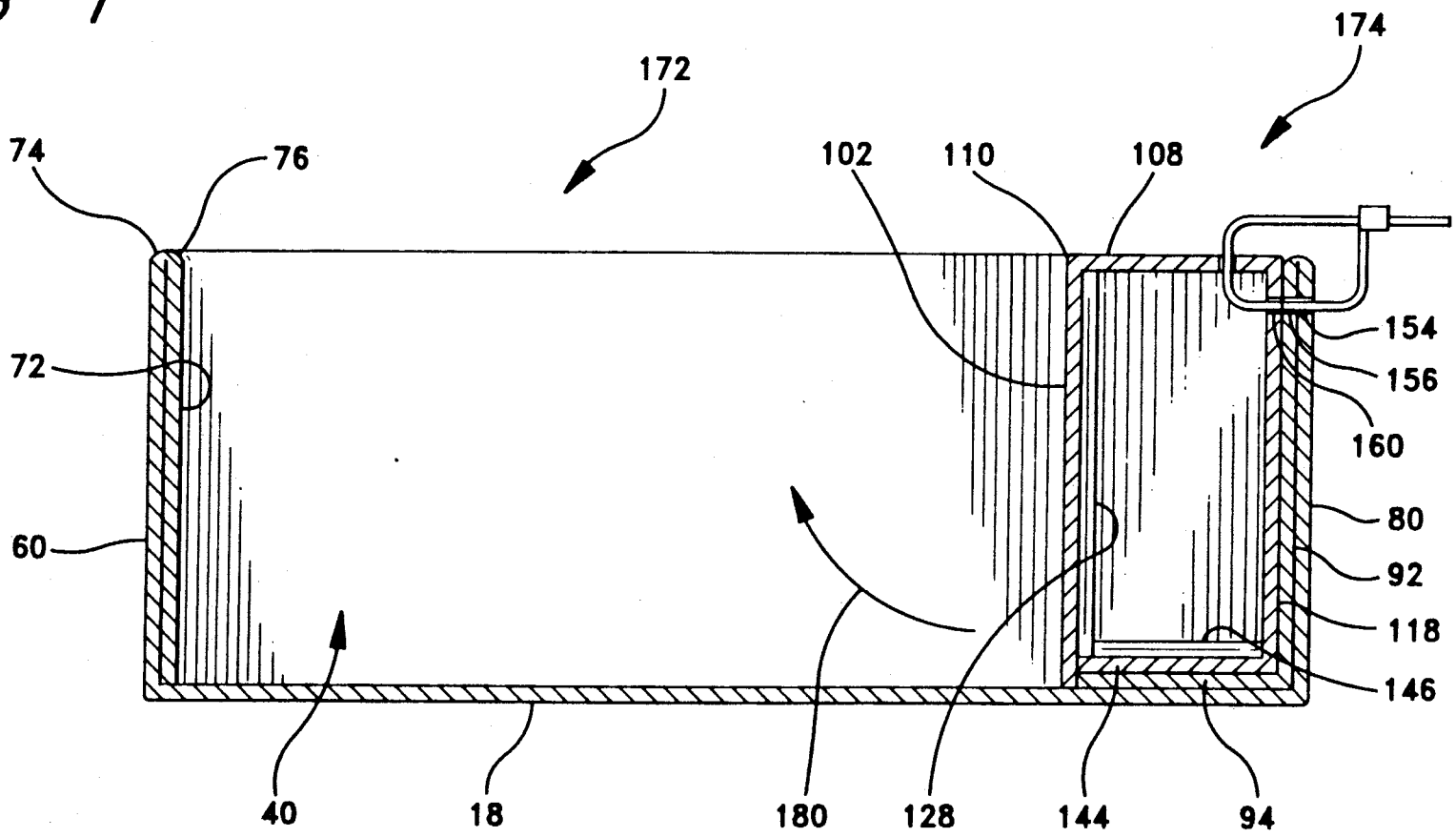
FIG. 7 shows a cross sectional view of the preferred embodiment of the present invention viewed along section line 7—7 as shown in FIG. 6.

Referring to FIG. 7, in conjunction with the previously described figures, it can be seen that in order for the coin box 170 to be accessed the coin box assembly 174 must be unfolded in the direction of arrow 180. To access the coin box 170, the coin box top panel 102 must be rotated about folding line 110 in the direction of the merchandise display section 172. In order to move the coin box top panel 102 in such a manner, the coin box top panel 102 can not be obstructed by either articles of merchandise or the compartment dividers 175. As such, it will be understood that the coin box assembly can only be unfolded, and the coin box 170 accessed, by removing the compartment dividers 175 and disrupting or removing the articles of merchandise held within the merchandise display section 172. Such an assembly orientation deters unauthorized access to the coin box assembly 174 by increasing the difficulty, time and labor involved in unfolding the coin box assembly and removing any money contained within the coin box 170. Furthermore, the coin box 170 can not be removed so the coins contained within the coin box 170 must be removed individually.

In FIGS. 6 and 7, a locking tie 182 is shown. The purpose of the locking tie 182 is to further deter the unauthorized access to the contents of the coin box 170 and prevent the coin box assembly from inadvertently unfolding. As can be seen from FIG. 7, when the coin box assembly is in its assembled orientation, the first lock aperture 154, formed through the bottom outside wall panel 80, is concentrically aligned with the second lock aperture 156 that is formed through the bottom inside wall panel 92. The fourth lock aperture 160, formed through the coin box bottom panel 118, aligns above the second lock aperture 156 thereby creating a continuous opening through the first, second and fourth apertures, respectively. The third lock aperture 158 is formed on the coin box face panel 108. The third lock aperture 158 is formed in a common plane with the first, second and fourth lock apertures 154, 156, 160, so that the locking tie 182 can easily pass through each of the four lock apertures. The locking tie 182 can be any type of locking fastener such as a string or a wire tie. However, in a preferred embodiment the locking tie 182 is a one-time-use tie that includes a one-way ratchet preventing the nondestructive removal of the locking tie 182. The locking tie 182 retains the coin box assembly in its folded position, thereby retaining the integrity of the coin box. To access the coin box 170, the locking tie 182 must be cut or otherwise destructively removed from the display box 10. Once the locking tie 182 is removed, the coin box assembly 174 can be unfolded until the contents of the coin box 170 can be accessed. However, as has been previously described, the presence of the dividers 175 and the merchandise within the merchandise compartment also prevent the coin box assembly 174 from being unfolded. Consequently, to open the coin box assembly 174, the locking tie 182 must be removed and both the merchandise and the dividers 175 must be removed from the merchandise compartment.

The locking tie 182 may be custom created, color coded or have some other identifying indicia means formed on it to prevent unauthorized persons from removing the locking tie 182 and replacing it with a common commercially available locking tab 182.

The present invention exemplified in FIGS. 1 through 7 shows an embodiment of the present invention wherein the present invention is used to form an honor based merchandise display. However, in view of the above description it should be understood that the present invention can be used in applications not described, where it is desired to have secured compartments within a larger container. For example, the present invention box can be used to ship confidential materials with other non-confidential materials, wherein the confidential documents are sealed within a folded compartment formed in the same manner as was described for the coin box. Since the coin box compartment of the present invention is sealed with a locking tie, any unauthorized opening of the present invention box could be detected. In a similar manner the present invention box can be easily altered to ship chemicals, pharmaceutical, or like products where it is desirable to restrict access and prevent tampering. All such modifications, to match the present invention to such applications, should appear obvious to a person skilled in the art in view of the above description, and are intended to be included within the scope and intent of the present invention.

Although the described embodiment of the invention is believed to represent the best mode of the present invention, it should be understood that many described components of the present invention have known functional equivalents. Additionally proportions, materials and orientations used within the description may be modified by a person skilled in the art. More particularly, although the present invention shows the presence of only one coin box, more than one can be used and the invention so practiced. All such modifications are intended to be covered by the scope of the invention as set forth in the appended claims.

What is claimed is:

1. A box comprising:

a first open compartment and a coin compartment sharing at least one common wall, wherein said first compartment and said coin compartment are unistructurally formed from a common folded blank of paper-based material, and wherein said second closed compartment is constructed of a plurality of interconnected folded panels that include at least a first panel and a second panel that separate when said second closed compartment is unfolded from a closed position, said first and second panels having apertures formed therethrough that align when said second closed compartment is in said closed position, and wherein a locking means joins said first and second panels through said apertures, preventing said second closed compartment from being unfolded from said closed position.

2. The box according to claim 1, further including a means for preventing said common wall from being unfolded into said first compartment thereby preventing said coin compartment from being unfolded from said closed position.

3. The box according to claim 2, further including at least one dividing member, said dividing member being removably positionable within said first compartment preventing said common wall from being unfolded into said first compartment.

4. The box according to claim 3, wherein said coin compartment includes a face wall, said face wall having a shaped aperture formed therethrough so that articles that can be passed through said shaped aperture can be introduced into said coin compartment without said second compartment being unfolded.

5. The box according to claim 4, wherein said shaped aperture is a coin slot, said coin slot allowing coined money to be introduced into said coin compartment.

6. The box according to claim 5, wherein said face wall of said second compartment has an indicia formed thereon, said indicia being indicative of a predetermined monetary value.

7. The box according to claim 1, wherein said locking means includes a plastic tie that cannot be nondestructively removed from said apertures once positioned therein.

8. The box according to claim 7, wherein said locking means includes a distinguishing indicia means formed thereon that identifies said locking means as being the same locking means originally used to lock together said first and second panels.

9. A container comprising:

a primary box having a base and four walls, said primary box being formed from a folded common piece of shaped cardboard material;

a secondary box formed within said primary box, said secondary box having a bottom panel, four walls and a top panel, so as to envelop and define an enclosed compartment, said secondary box being unistructurally formed from a segment of said common piece of shaped cardboard material, wherein said segment depends from at least one wall of said primary box and;

a coin slot is formed through said face panel of said secondary box, thereby allowing coined money to be passed into said enclosed compartment of said secondary box.

10. The container according to claim 9, further including a locking means for locking said secondary box into a folded orientation while within said primary box, said locking means preventing said secondary box from being unfolded from said folded orientation until said locking means is removed.

11. The container according to claim 9, further including a plurality of dividing members, said dividing members being removably positionable within said primary box, preventing said secondary box from being unfolded.

12. The container of claim 11, wherein a first aperture is formed through one wall of said primary box and a second aperture is formed through said bottom panel of said secondary box, such that said first aperture and said second aperture align when said secondary box is in said set position and wherein said locking means passes through said first and second apertures, preventing said second box from being unfolded.

13. The box according to claim 9 wherein said face panel of said secondary box has an indicia formed thereon, said indicia being indicative of a predetermined monetary value.

14. The box according to claim 10 wherein said locking means includes a tie that traverses said first aperture and said second aperture, wherein said tie cannot be nondestructively removed once engaged through said first aperture and said second aperture.

15. A merchandise display box comprising an open merchandise compartment and a coin box compartment formed from a single folded blank of paper based material, wherein said coin box compartment can be unfolded from a closed position to access any monies deposited therein, and wherein at least one aperture is formed through both said merchandise compartment and said coin box compartment, and a locking means is placed through said at least one aperture locking said coin box compartment in said closed position.

16. The display box according to claim 15, further including at least one dividing member removably positionable within said merchandise compartment, preventing said coin box compartment from unfolding from said closed position.

17. The display box according to claim 15, wherein said coin box compartment has a face panel on which is formed a coin slot, said coin slot thereby allowing money to be passed into said coin box compartment.

18. The display box according to claim 15, wherein said locking means includes a mechanical fastener that traverses said at least one aperture in said merchandise compartment and said coin box compartment preventing said coin box compartment from being unfolded from said closed position.

19. The display box according to claim 17, wherein said face panel of said coin box compartment has an indicia formed thereon, said indicia being indicative of a predetermined monetary value.

* * * * *